US010294587B2

(12) United States Patent
Stephan

(10) Patent No.: US 10,294,587 B2
(45) Date of Patent: May 21, 2019

(54) METHOD FOR OPERATING A WORK STATION OF A TEXTILE MACHINE

(71) Applicant: Rieter Ingolstadt GmbH, Ingolstadt (DE)

(72) Inventor: Adalbert Stephan, Beilngries/Paulushofen (DE)

(73) Assignee: Rieter Ingolstadt GmbH, Ingolstadt (DE)

( * ) Notice: Subject to any disclaimer, the term of this patent is extended or adjusted under 35 U.S.C. 154(b) by 11 days.

(21) Appl. No.: 15/634,525

(22) Filed: Jun. 27, 2017

(65) Prior Publication Data

US 2017/0370025 A1 Dec. 28, 2017

(30) Foreign Application Priority Data

Jun. 28, 2016 (DE) ..... 10 2016 111 841

(51) Int. Cl.

| | |
|---|---|
| ***D01H 13/26*** | (2006.01) |
| ***D01H 13/02*** | (2006.01) |
| ***B65H 54/26*** | (2006.01) |
| ***B65H 63/04*** | (2006.01) |
| ***B65H 67/08*** | (2006.01) |
| ***D01H 13/00*** | (2006.01) |
| ***D01H 15/013*** | (2006.01) |

(52) U.S. Cl.

CPC ..... *D01H 13/26* (2013.01); *B65H 54/26* (2013.01); *B65H 63/04* (2013.01); *B65H 67/081* (2013.01); *D01H 13/005* (2013.01); *D01H 13/02* (2013.01); *D01H 15/013* (2013.01); *B65H 2701/31* (2013.01)

(58) Field of Classification Search

CPC .... D01H 13/005; D01H 13/013; D01H 13/26; B65H 54/26; B65H 63/04; B65H 67/081

USPC ..... 700/139, 143

See application file for complete search history.

(56) References Cited

U.S. PATENT DOCUMENTS

| | | | | |
|---|---|---|---|---|
| 4,178,749 A | | 12/1979 | Stahlecker et al. | |
| 4,986,482 A | * | 1/1991 | Okayama | B65H 67/085 242/475.4 |
| 5,082,194 A | | 1/1992 | Grecksch et al. | |

(Continued)

FOREIGN PATENT DOCUMENTS

| | | |
|---|---|---|
| DE | 24 54 721 A1 | 5/1976 |
| DE | 27 25 105 A1 | 12/1978 |

(Continued)

OTHER PUBLICATIONS

German Patent Office Search Report, dated Feb. 8, 2017.
EPO Search Report, dated Nov. 20, 2017.

*Primary Examiner* — Nathan E Durham
(74) *Attorney, Agent, or Firm* — Dority & Manning, P.A.

(57) ABSTRACT

A method for operating a work station of a textile machine that produces or rewinds yarn in a normal operation, wherein the normal operation is interrupted. The method includes performing at least one service step for restoring the normal operation, wherein a service result is specified for the service step. A standard service operation is carried out with a service device until the service result has been achieved or a predetermined number of failed attempts has been reached. When the predetermined number of failed standard service operation attempts has been reached, an extended service operation is carried out.

12 Claims, 3 Drawing Sheets

(56) References Cited

U.S. PATENT DOCUMENTS

| | | | |
|---|---|---|---|
| 5,385,009 | A | 1/1995 | Schuller |
| 6,226,971 | B1 | 5/2001 | Stephan |
| 2005/0182509 | A1 | 8/2005 | Brandl et al. |

FOREIGN PATENT DOCUMENTS

| | | | |
|---|---|---|---|
| DE | 39 33 507 | A1 | 4/1990 |
| DE | 43 25 227 | A1 | 2/1994 |
| DE | 199 17 971 | A1 | 11/1999 |
| DE | 10 2004 041 051 | A1 | 6/2005 |
| EP | 0 427 990 | A2 | 5/1991 |
| EP | 2 388 224 | A2 | 11/2011 |

* cited by examiner

METHOD FOR OPERATING A WORK STATION OF A TEXTILE MACHINE

FIELD OF THE INVENTION

The present invention relates to a method for operating a work station of a textile machine that produces and/or rewinds yarn in a normal operation, whereas the normal operation is interrupted at intervals and at least one service step is carried out for restoring the normal operation. A service result is specified for each service step and a service device carries out a standard service operation until the service result has been achieved or a predetermined number of failed attempts has been reached.

BACKGROUND

This method for operating a work station of a textile machine is well-known. Herein, the textile machine may comprise a spinning machine or a winding machine that produces or rewinds the yarn. The production or the rewinding of yarn is interrupted at intervals, for example by a yarn breakage, a clearer cut, a change to the template material or an exchange of a full receiver coil with an empty sleeve. In this regard, a yarn breakage is an unintentional breakage or unwanted tearing of the yarn, for example due to a faulty spot in the template material. On the other hand, a clearer cut denotes the desired cutting out of a yarn section, because it does not have the desired properties, for example thickness or cleanliness. A sufficiently automated textile machine independently carries out the necessary service steps in order to resume normal operation.

If such a service step has not been successfully carried out, it is normally repeated until a predetermined number of failed attempts has been reached. If the service step can still not be successfully carried out after this predetermined number of failed attempts, the carrying out of such service step is terminated. Thereupon, operators who are to correct the fault at the affected work station are then requested to do so, for example by corresponding visual signals. It may take some time before the operator corrects this fault. During this time, the work station cannot carry out its normal operation and its productivity is equal to zero. In addition, operators are required to correct the fault. With textile machines becoming larger and larger, this signifies a great number of employees.

Both the periods of time in which the work station cannot carry out its normal operation and the costs for the operator are disadvantageous in terms of cost-efficiency.

SUMMARY OF THE INVENTION

Thus, a task of the present invention is to provide a method for operating a work station of a textile machine and a textile machine that counteracts this disadvantage, that is, that the method allows the work station to resume its normal operation more quickly and/or less intervention by operators is required. Additional objects and advantages of the invention will be set forth in part in the following description, or may be obvious from the description, or may be learned through practice of the invention.

The tasks are achieved by a method for operating a work station of a textile machine and a textile machine with the characteristics set forth herein.

A method for operating a work station of a textile machine that produces and/or rewinds yarn in a normal operation is proposed. Such textile machine comprises a spinning machine, for example a ring, rotor or air spinning machine, or a winding machine. The normal operation of the work station is interrupted at intervals. This may have a variety of causes, for example a yarn breakage, a clearer cut (that is, a deliberate cutting out of a yarn section), a change to the template material, or an exchange of a full receiver coil with an empty sleeve.

In order to restore normal operation during such an interruption, at least one service step is carried out. A service result is specified for each service step. Such a service result may be, for example, that the yarn is located at a certain spot in the work station. Whether or not the service result has been achieved is determined by a sensor system, for example a yarn sensor.

A service device carries out a standard service operation until the service result has been achieved or a predetermined number of failed attempts has been reached.

In accordance with the invention, if the predetermined number of failed attempts has been reached, an extended service operation is carried out. Thus, the operator is not immediately requested to do so; rather, the textile machine initially executes the extended service operation automatically. In many cases, this leads to achieving the service result. In the successful cases, the operator is thus not at all required, which in turn leads to a lower need for operator personnel and therefore lower personnel costs. Furthermore, the automatic carrying out of the extended service operation is often more rapid than a manual intervention by the operator. Thus the work station can resume normal operation earlier, which further increases the productivity of the textile machine.

Advantageously, the carrying out of the extended service operation is indicated. Thus, the operator can recognize that the extended service operation is carried out at a particular work station. This may be useful in a number of respects: if, for example, the operator is at or near the work station, the operator may, if necessary, carry out the service step by hand. Furthermore, it can be recognized when an extended service operation is carried out at a work station at above-average frequency. In this case, the operator can search for the cause.

It is also advantageous if a visual and/or an acoustic signal is emitted during the carrying out of the extended service operation. A light that is illuminated in a specific color, flashes according to a particular pattern, and/or represents a specific symbol is conceivable as the visual signal. As an acoustic signal, for example, a single tone or a tone sequence can indicate the extended service operation being carried out. In all cases, it is clearly indicated to the operator that the extended service operation is being carried out.

The visual and/or acoustic signal is advantageously emitted at the work station, at a central point of the textile machine, and/or at a display device that is removed or removable from the textile machine. The emission of the signal directly at the work station makes it easier for the operator, who is in the vicinity of the work station, to take note of the carrying out of the extended service operation. If, on the other hand, the signal is emitted at a central point of the textile machine, the operator can obtain an overview of the extended service operations being carried out. Finally, the signal may be emitted at a display device that is removed or removable from the textile machine. Such a display device may be, for example, a part of a control unit removed from the textile machine or a portable electronic device, such as a smartphone. In particular, the emission of the signal to a portable electronic device allows the operator to be informed of the carrying out of extended service operations.

Furthermore, it is advantageous if the extended service operation comprises a modified service operation. Herein, the modified service operation is modified in such a manner that, with its carrying out, the probability of achieving the service result increases. If the service result can be achieved with the modified service operation, a request to the operator and the associated standstill of the work station are avoided.

It is advantageous if the modified service operation corresponds to the standard service operation, but is carried out with parameters that are changed compared to the standard service operation and/or by a different service device. In this connection, "corresponds" means that the service result of the standard service operation and the modified operation should be the same. In doing so, the methods of achieving the service result may be similar but also different.

An example of this is yarn search; that is, the search for a yarn end on the coil. The standard service operation can be carried out in such a manner that a vacuum nozzle that is subjected to negative pressure is held at a small distance in front of the coil. The coil is then rotated backwards—compared to the direction of rotation in normal operation—and the yarn end is sucked into the suction nozzle by the suction. The service result is recorded by a yarn sensor, which checks whether or not the yarn end has been sucked in. If the yarn end has not been sucked in, the service result is not achieved; thus, the yarn search operation is repeated. After a predetermined number of failed attempts, the extended service operation, which comprises a modified service operation, is then carried out. The modified service operation corresponds to the standard service operation; thus, the modified search operation comprises a yarn search operation. This can be carried out with changed parameters, in this example with increased negative pressure or with the suction nozzle even closer to the coil. A greater consumption of negative pressure or the risk of slight damage to the yarn on the surface of the coil is thereby accepted. If the modified service operation is carried out by another service device, it is conceivable for this service device to feature special, even more efficient, suction nozzles. However, the other service device may also feature brushes, by means of which the yarn end is brushed off the coil surface.

It is also advantageous if the extended service operation comprises a supporting service operation and, after the supporting service operation, the standard service operation and/or the modified service operation are carried out. In this case, the supporting service operation does not follow the same service result as the standard service operation; rather, it serves the purpose of the standard service operation and/or modified service operation following the supporting service operation achieving the service result with greater probability.

Advantageously, the supporting service operation is a cleaning operation and/or an exchange operation. If the standard service operation is unsuccessful due to a contaminated component of the work station, a cleaning (for example, with compressed air, with negative pressure, or mechanically with brushes) obviously offers an improvement to this contaminated component. The same situation arises if a component has a fault. Then, the exchange of this faulty component will improve the standard service operation and/or modified service operation.

It is advantageous if, during the exchange operation, a template material, a receiver coil or sleeve and/or parts of the work station, in particular wear parts, are exchanged. The exchange of the template material is useful if the template material has faults (for example, long thin parts) or is completely missing. A receiver coil, which is at least partly spooled, can be exchanged for an empty receiver sleeve. Finally, the exchange of parts of the work station, in particular wear parts, is advantageous because defective parts and/or worn wear parts can hinder the service operations.

Furthermore, it is advantageous if an operation for determining the cause and/or the point of time of the fault is carried out, in particular at the beginning of the service step and/or as part of the extended service operation. In doing so, the cause and/or the point of time of the fault can be precisely determined. However, it is also conceivable that they are only isolated. For example, a certain assembly of the work station can be determined as the cause of the fault, or a certain phase of the service operation can be determined as the point in time of the fault. Depending on the result of this operation for determining the cause and/or the point of time of the fault, the selection of the subsequent operations is then made, or the service step and/or the extended service operation is aborted. In this manner, a reaction may be selectively made to the fault, which makes it easier to achieve the service result. However, if it turns out that the fault cannot be automatically corrected by a service device, no further resources are wasted on the carrying out of the service step and/or the extended service operation, and this is aborted. In this case, the intervention of operator is necessary.

It is also advantageous if the result of the operation for determining the cause and/or the point of time of the fault, or the operation selected on the basis of this result, is made clear, in particular in a visual and/or acoustic manner. This allows the operator to recognize conspicuous accumulations of certain types of faults.

Advantageously, the standard service operation, the modified service operation, and/or the supporting service operation are carried out by a service device of the work station, a robot, a traveling cleaner, and/or a special additional service unit. Here, a robot is a unit of the textile machine that can carry out many and/or complicated tasks automatically, for example a piecing robot, which sets the yarn, or a doffing robot, which exchanges a full receiver coil for an empty sleeve. A traveling cleaner is primarily equipped with devices for cleaning the work station and/or the textile machine, in particular with compressed air nozzles, suction nozzles, and mechanical cleaning elements. A special, additional service unit ultimately resembles a robot, but is limited to carrying out simpler tasks. When carrying out the individual service operations through the individual devices, a wide range of combination options are possible. For example, the standard service operation can be carried out by a service device of the work station, the modified service operation can be carried out by a robot, and the supporting service operation can be carried out by a special service unit. However, for example, both the standard service operation and the modified service operation can also be carried out by a robot. In general, each of the standard service operation, the modified service operation, and the supporting service operation can be carried out by the same service device or by different service devices. Depending on the type of the textile machine, such combination options may vary in terms of cost efficiency.

It is also advantageous if a maintenance priority is assigned to each work station, and such maintenance priority is set lower when an extended service operation is carried out. The maintenance priority thereby influences the sequence of the maintenance of the work station, for example by means of a robot, or also by means of a service device of the work station, if the resources—for example, electrical current or negative pressure—are not sufficient to maintain all work stations with which the maintenance need exists. If an extended service operation is then carried out, this indicates that the work station has been less successful in carrying out the standard service operation. Therefore, it is also possible that the work station will also be less successful upon further standard service operations. By reducing the maintenance priority of the less successful work station, more successful work stations are preferred, and thus the productivity of the textile machine is increased.

Furthermore, it is advantageous if the number of modified service operations and/or supporting service operations that are carried out, as a function of the work station at which they were carried out, and/or the number of unsuccessfully carried out service operations, as a function of the service device that has carried them out, are recorded, and in particular an accumulation of this number is indicated. An accumulation of this number indicates that the relevant work station or service device may be faulty. The operator can then subject the relevant work station or service device to an inspection and, if necessary, repair it, replace it, or take it out of operation.

Finally, it is advantageous if the standard service operation is a piecing operation, a yarn search operation, a doffing operation, and/or a splicing operation. During the piecing operation, the yarn is set at a spinning unit, and a yarn end that has been wound onto a coil is searched for during the yarn search operation. The doffing operation comprises the exchange of a mostly full receiver coil with an empty sleeve, and, upon the splicing operation, two yarn ends are connected to each other. These are operations that are frequently carried out, and with which the automatic handling of problems is particularly worthwhile.

The method is carried out according to the preceding description, whereas the specified characteristics can be present individually or in any desired combination.

Furthermore, a textile machine that features a control unit that is formed to operate the textile machine according to the method described above is provided. Here, the textile machine may be a spinning machine, in particular a ring, rotor, or air spinning machine, or a winding machine. If the textile machine is operated according to the method described above, it has the advantages of the method described above, in particular the reduced need for operators and the shorter times in which work stations of the textile machine are not productive.

Herein, the control unit of the textile machine may be a central control unit, a control unit distributed to the work stations, or a control unit that is partially central and partially distributed to the work stations. How the control unit is precisely formed depends on details of the textile machine and the service operations to be carried out.

BRIEF DESCRIPTION OF THE DRAWINGS

Further advantages of the invention are described in the following embodiments. The following is shown.

DETAILED DESCRIPTION

Figure 1:
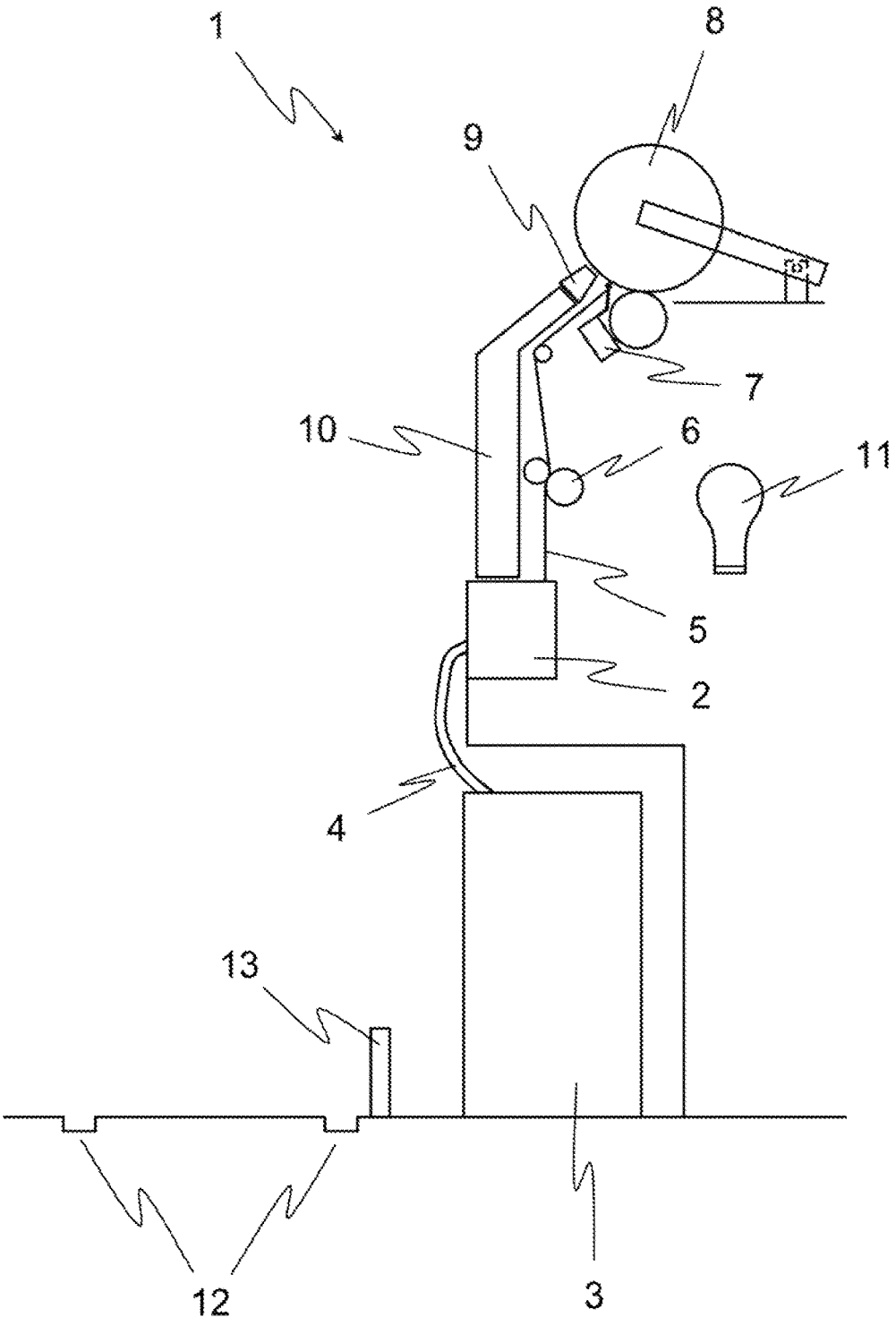
FIG. 1 is a side view of a work station.

Reference will now be made to embodiments of the invention, one or more examples of which are shown in the drawings. Each embodiment is provided by way of explanation of the invention, and not as a limitation of the invention. For example features illustrated or described as part of one embodiment can be combined with another embodiment to yield still another embodiment. It is intended that the present invention include these and other modifications and variations to the embodiments described herein.

FIG. 1 shows a work station 1 of a textile machine. In this case, the textile machine is a rotor spinning machine. However, in principle, the method in accordance with the invention is applicable to other spinning machines, such as ring or air spinning machines, or to winding machines.

The work station 1 features a spinning unit 2, which spins a sliver 4 coming from a can 3 into a yarn 5. The yarn 5 is then taken up by a pair of draw-off rollers 6 and wound on a coil 8 by means of a traverse element 7.

Furthermore, the work station 1 features a yarn search device 9 and a piecing device 10. In the event of yarn breakage, a yarn end is wound onto the coil 8. Then, a suction nozzle of the yarn search device 9 is moved near the surface of the coil 8. Thereupon, the suction nozzle is subjected to negative pressure, and the coil 8 is rotated backwards—compared to the spinning operation. The yarn end is thereby sucked in from the suction nozzle of the yarn search device 9. The yarn end is then transferred from the yarn search device 9 to the piecing device 10. The piecing device 10 sets the yarn end at the spinning unit 2 and the work station 1 is able to continue its spinning operation.

If, on the other hand, the yarn search operation is not successful, the yarn search device 9 once again carries out a yarn search operation. This is repeated until the yarn end has been found or until a predetermined number of failed attempts has been reached. If the predetermined number of failed attempts has been reached, an extended service operation is carried out. The carrying out of the modified service operation is indicated by a light signal 11 to the operator.

In this embodiment, the extended service operation comprises a modified service operation—this modified service operation is also a yarn search operation carried out by the yarn search device 9. Compared to the standard yarn search operation, the negative pressure is temporarily increased during the modified service operation, which, on the one hand, consumes more energy and increasingly stresses the yarn on the coil surface, but, on the other hand, increases the likelihood that the yarn end is found.

FIG. 1 also shows rails 12 along which mobile maintenance devices can be moved. In order for the maintenance devices to be precisely positioned at the work station 1, a positioning element 13 is also provided.

In the following description of the alternative embodiment shown in FIG. 2, the same reference signs are used for characteristics that are identical and/or at least comparable in their design and/or mode of operation in comparison to the first embodiment shown in FIG. 1. To the extent that such are not described once again in detail, their designs and/or modes of action correspond to the designs and modes of action of the characteristics described above.

Figure 2:
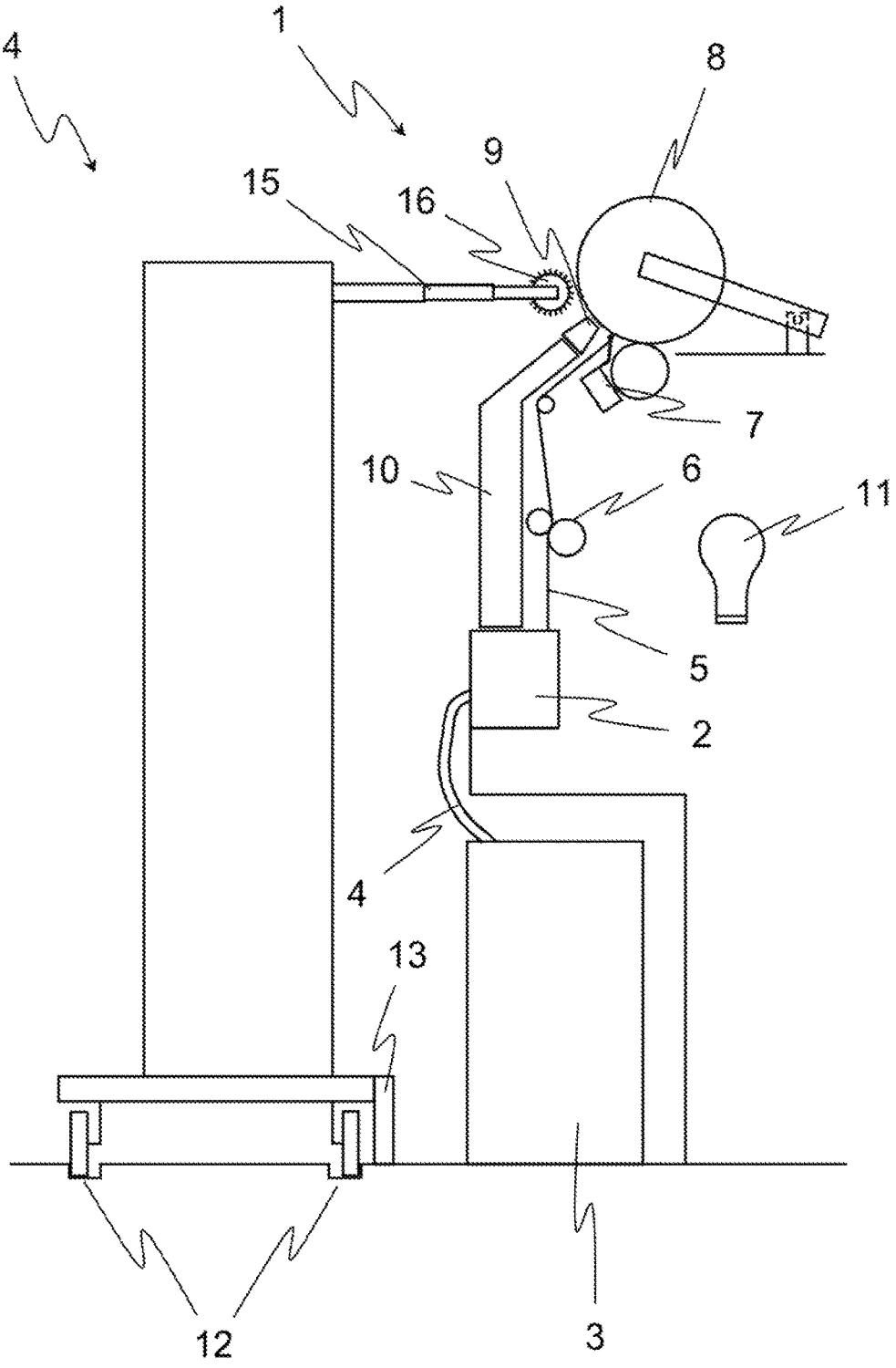
FIG. 2 is a side view of a work station with a service unit.

FIG. 2 also shows the work station 1 of the textile machine. After a yarn breakage, the yarn search device 9 has carried out the predetermined number of standard yarn search operations, but all of them have been unsuccessful. Thereupon, the extended service operation is carried out. In this embodiment, the extended service operation once again comprises a modified service operation, which is carried out here by an additional service unit 14.

The carrying out of the extended service operation is again indicated by the light signal 11. The additional service unit 14 is requested by the work station 1 and travels along the rails 12 to the work station 1, where it is precisely positioned with the assistance of the positioning element 13.

The additional service unit 14 features a brush 16 that is rotatably mounted on a telescopic arm 15. The telescopic arm 15 is extended until the brush 16 makes contact with the surface of the coil 8. Then, the coil 8 is rotated in a reverse direction, and the brush 16 is likewise rotated, such that the yarn end is released from the coil 8. The yarn end that is then released is then sucked in by the yarn search device 9, and is then further transferred to the piecing device 10.

Figure 3:
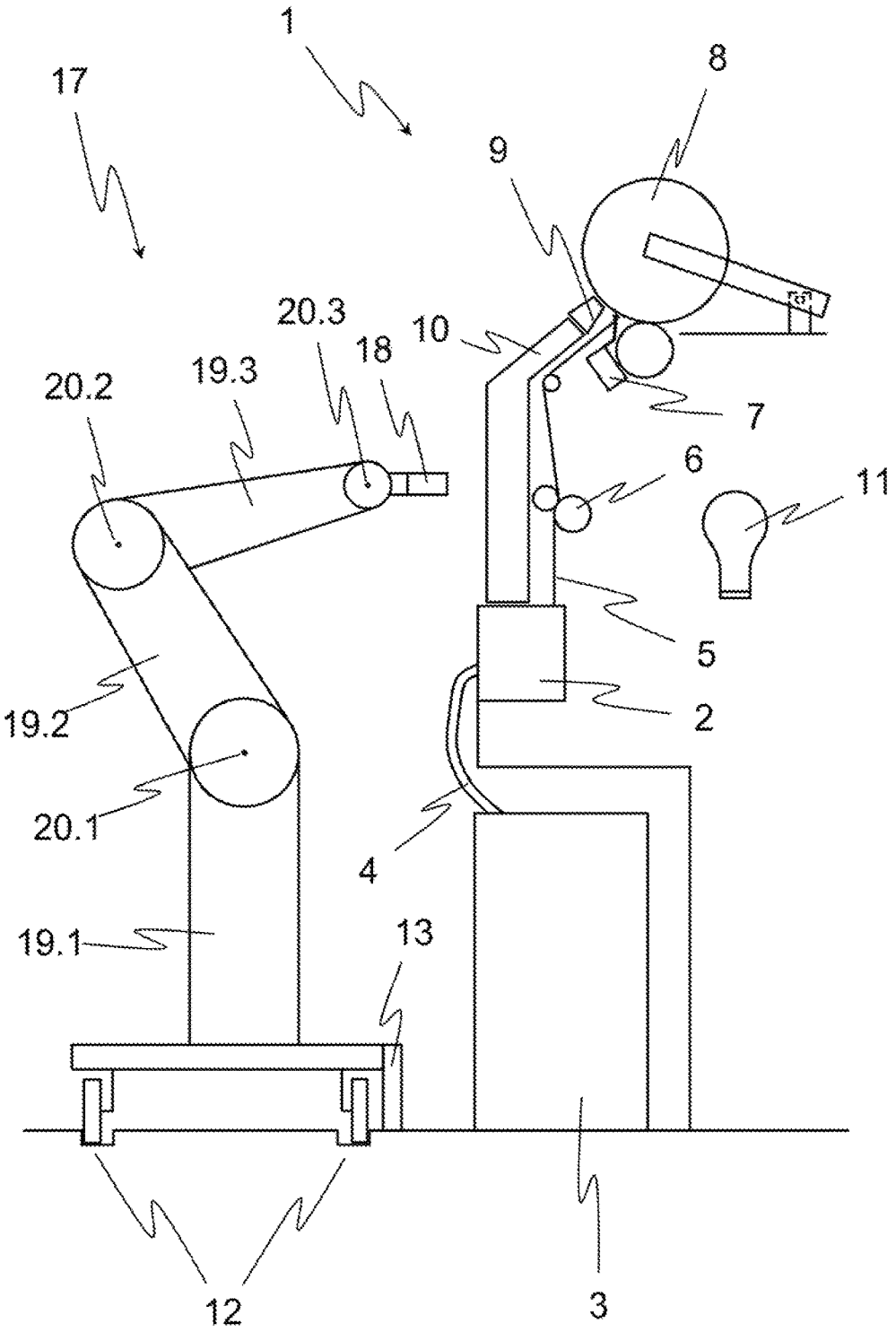
FIG. 3 is a side view of a work station with a traveling cleaner.

In the embodiment shown in FIG. 3, the yarn search operation has been successfully carried out, but a predetermined number of failed attempts has occurred upon the piecing operation carried out by the piecing device 10. Thereupon, the extended service operation is carried out, which is indicated by the light signal 11.

In this embodiment, the extended service operation comprises a supporting service operation. For the supporting service operation, the work station 1 requests a traveling cleaner 17, which travels along the rails 12 to the work station 1 and positions itself precisely at the work station 1 with the assistance of the positioning element 13. The traveling cleaner 17 moves a blowing nozzle 18 with the assistance of three arms 19 and three hinges 20, in such a manner that it frees from dirt the areas of the piecing device 10 that are relevant for the piecing operation. After cleaning has taken place, the standard piecing operation is repeated by the piecing device 10. Since the piecing operation is no longer impaired by dirt, the probability that it is successfully carried out is increased.

This invention is not limited to the illustrated and described embodiments. Variations within the scope of the claims, just as the combination of characteristics, are possible, even if they are illustrated and described in different embodiments.

LIST OF REFERENCE SIGNS

1 Work station
2 Spinning unit
3 Can
4 Sliver
5 Yarn
6 Pair of draw-off rollers
7 Traverse element
8 Coil
9 Yarn search device
10 Piecing device
11 Light signal
12 Rails
13 Positioning element
14 Additional service unit
15 Telescopic arm
16 Brush
17 Traveling cleaner
18 Blowing nozzle
19 Arm
20 Hinge

The invention claimed is:

1. A method for operating a work station of a textile machine that produces or rewinds yarn in a normal operation, wherein the normal operation is interrupted, comprising:

performing at least one service step for restoring the normal operation, wherein a service result is specified for the service step;

carrying out a standard service operation with a service device to achieve the service result;

upon reaching a predetermined number of failed attempts of the standard service operation without achieving the service result, performing an extended service operation;

wherein the extended service operation comprises a supporting service operation that includes one or both of a cleaning, operation or an exchange operation selected, to increase probability of success of achieving the service result; and wherein the extended service, operation further comprises a modified service operation performed subsequent to the supporting service operation with parameters that are changed compared to the standard service operation, or with a different service device than is used for the standard service operation.

2. The method according to claim 1, further comprising generating an indication to service personnel that the extended service operation is being performed.

3. The method according to claim 2, wherein the indication is one or both of a visual or an acoustic signal.

4. The method according to claim 3, wherein the visual or acoustic signals are emitted at the work station, at a central point of the textile machine, or at a display device that is remote from the textile machine.

5. The method according to claim 1, wherein one or more of the standard service operation, the modified service operation, or the supporting service operation are carried out by a service device of the work station, a robot, a traveling cleaner, or an additional service unit.

6. The method according to claim 1, further comprising recording one or both of a number of the modified service operations or the supporting service operations that are carried out at individual work stations, or recording a number of unsuccessfully carried out service operations performed by particular service devices.

7. The method according to claim 1, wherein the exchange operation is exchange of one or more of: a template material; a receiver coil; a sleeve; or parts of the work station.

8. The method according to claim 1, wherein the normal operation is interrupted due to a fault, the method further comprising performing an additional operation at a start of the service step or as part of the extended service operation to determine one or both of a cause of the fault or time of the fault, wherein one or more of the following is performed depending on a result of the additional operation: selection of subsequent operations at the work station, aborting the service step, or aborting the extended service operation.

9. The method according to claim 8, wherein the result of the additional operation is made clear to service personnel by a visual or acoustic indication.

10. The method according to claim 1, wherein a maintenance priority is assigned to each work station, the maintenance priority set lower when an extended service operation is carried out.

11. The method according to claim 1, wherein the standard service operation is a setting operation, a yarn search operation, a doffing operation, or a splicing operation.

12. A textile machine, comprising a control unit configured to operate the textile machine when normal operation for operating a work station of the textile machine that produces or rewinds yarn is interrupted, as follows:

performing at least one service, step for restoring the normal operation, wherein a service result is specified for the service step;

carrying out a standard service operation with a service device to achieve the service result;

upon reaching a redetermined number of failed attempts of the standard service operation without achieving the service result, performing an extended service operation, wherein, the extended service operation comprises a supporting service operation that includes one or both of a cleaning operation or an exchange operation selected to increase probability of success of achieving the service result; and wherein the extended service operation further comprises a modified service operation performed subsequent to the supporting service operation with parameters that are changed compared to the standard service operation, or with a different service device than is used for the standard service operation.

* * * * *